United States Patent [19]

Watkins et al.

[11] 4,261,501

[45] Apr. 14, 1981

[54] LAMINATED INSULATED HOT DRINK CUP

[75] Inventors: John B. Watkins, Independence, Mo.; Glen N. Black, Osage City, Kans.

[73] Assignee: Hallmark Cards Incorporated, Kansas City, Mo.

[21] Appl. No.: 89,762

[22] Filed: Oct. 31, 1979

[51] Int. Cl.[3] ..... B65D 3/22; B65D 25/20

[52] U.S. Cl. ..... 229/1.5 B; 220/445; 220/469

[58] Field of Search ..... 229/1.5 B, 3.5 MF; 206/519, 520; 220/445, 469, 72

[56] References Cited

U.S. PATENT DOCUMENTS

| | | | |
|---|---|---|---|
| Re. 25,618 | 7/1964 | Goodman | 229/1.5 B |
| 2,266,828 | 12/1941 | Sykes | 229/1.5 B |
| 2,675,954 | 4/1954 | Vogel | 229/1.5 B |
| 3,169,689 | 2/1965 | Schwartz | 229/1.5 B |
| 3,237,834 | 3/1966 | Davis et al. | 229/1.5 B |
| 3,456,860 | 7/1969 | Janninck | 229/1.5 B |
| 3,759,437 | 9/1973 | Amberg | 229/1.5 B |

FOREIGN PATENT DOCUMENTS

| | | | |
|---|---|---|---|
| 613857 | 2/1961 | Canada | 229/3.5 MF |
| 1085536 | 10/1967 | United Kingdom | 229/1.5 B |

*Primary Examiner*—George E. Lowrance

*Attorney, Agent, or Firm*—Schmidt, Johnson, Hovey & Williams

[57] ABSTRACT

An insulated, decorative hot drink cup for hot coffee or the like is provided which can be grasped and drunk from without fear that the user's fingers will be burned. The cup includes an inner, integral, synthetic resin cup member having a series of spaced, exterior, longitudinally extending, triangular in cross section ribs on the sidewall thereof, and an outer decorative paper overwrap permanently applied over and in contact with the ribs. This structure defines a series of discrete, juxtaposed, dead air chambers or cells in the cup assembly sidewall for maximum heat insulation, and the thermally minimal, essentially line contact between the rib apices and overwrap enhances this effect. An uppermost circumferential bead formed on the cup member provides a further seal and prevents passage of liquid between the overwrap and member sidewall.

9 Claims, 6 Drawing Figures

LAMINATED INSULATED HOT DRINK CUP

BACKGROUND OF THE INVENTION

1. Field of the Invention

The present invention is concerned with an improved, decorative cup especially adapted for use in drinking of hot liquids such as coffee or tea without causing discomfort to or injuring the hands of the user by virtue of heat transmitted from the hot liquid through the cup sidewall. More particularly, it is concerned with such an improved cup which is characterized by a series of elongated, side-by-side, discrete dead air cells in the sidewall thereof for thermal insulation purposes.

2. Description of the Prior Art

Disposable paper or synthetic resin drinking cups are of course extremely common. Simple paper cups are quite acceptable for holding cold or lukewarm beverages, but they present problems when used for hot drinks such as coffee or tea, which may be 170–175° F. in temperature. In such cases the user tends to grasp the cup between thumb and forefinger at the upper and lower extremities of the cup, so as to avoid grasping the cup sidewall. While this alleviates the problem to some extent, it is extremely awkward and may result in spillage of the hot liquid onto the user.

Another expedient resorted to in the past with paper cups has been the provision of a paper handle secured to the cup sidewall. These handles do provide a means of cup manipulation without directly grasping the cup sidewall; nevertheless, they present significant problems inasmuch as manufacturing costs are increased and because such handles tend to break away from the cup body during use thereof.

Another type of hot drink cup in widespread use is formed of a foamed synthetic resin material. Such cups have excellent thermal insulation characteristics and adequately protect the hands of a user even when an extremely hot beverage is being drunk. However, it is very difficult to decorate such foamed, insulative cups, and for the most part these are simply sold and used in an undecorated condition. Thus, the foamed cups cannot generally be provided with matched sets of party goods, inasmuch as such sets must include decorative hot drink cups.

Accordingly, there is a real need in the art for an insulated hot drink cup which can be provided with high quality, aesthetically pleasing decorations, and which can be used for the drinking of very hot liquids.

SUMMARY OF THE INVENTION

The preferred hot drink cup of the invention broadly includes a synthetic resin cup member having a decorative, paper overwrap permanently disposed about the sidewall thereof in order to create a laminated unit. The cup also includes structure defining a series of elongated, upright, discrete, dead air chambers or cells between the synthetic resin sidewall and overwrap, so as to give desirable insulative qualities.

Preferably, the synthetic resin cup member includes, on the exterior face thereof, a pair of annular, continuous bands extending about the member sidewall and located adjacent the upper and lower extremities thereof. The bands are spaced outwardly a short distance from the major surface of the sidewall, and are adapted to engage the corresponding margins of the paper overwrap. A series of elongated, spaced, juxtaposed spacer ribs are further provided on the exterior face of the cup member sidewall and present, on the outermost extremities thereof, respective, relatively sharp pointed contact lines. The overwrap is adhesively secured to the spaced, annular bands, and is in contact with the respective, longitudinally extending, sharp contact lines. In this fashion thermal contact between the synthetic resin sidewall of the cup member and the overwrap is minimized.

The preferred cup of the invention also includes an uppermost, circumferential, circular bead which extends outwardly and engages the upper margin of the paper overwrap for preventing passage of liquid between the cup member sidewall and overwrap. In addition, a series of spaced, circularly arranged, upstanding nibs are formed at the junction between the sidewall and bottom wall of the cup member, in order to facilitate the separation of a series of nested cups.

DESCRIPTION OF THE PREFERRED EMBODIMENT

Figure 1:
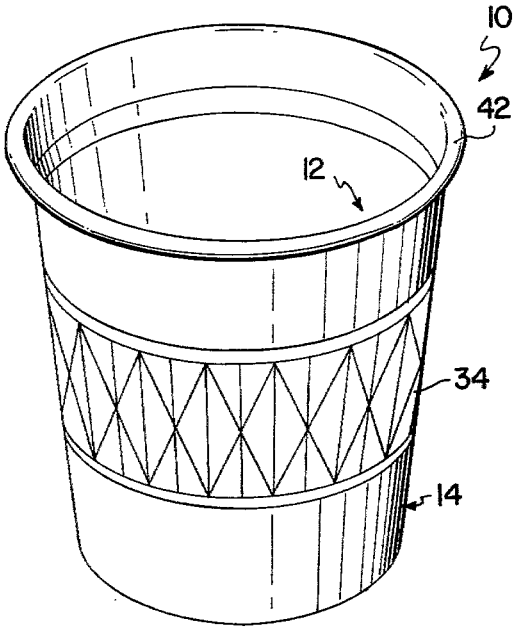
FIG. 1 is a perspective view of a completed hot drink cup in accordance with the invention.

Turning now to the drawing, a hot drink cup 10 in accordance with the invention is illustrated perspectively in FIG. 1 and broadly includes an inner, liquid-holding synthetic resin cup member 12 and an outer, decorated paper overwrap 14 applied to the sidewall of the cup member 12.

Figure 4:
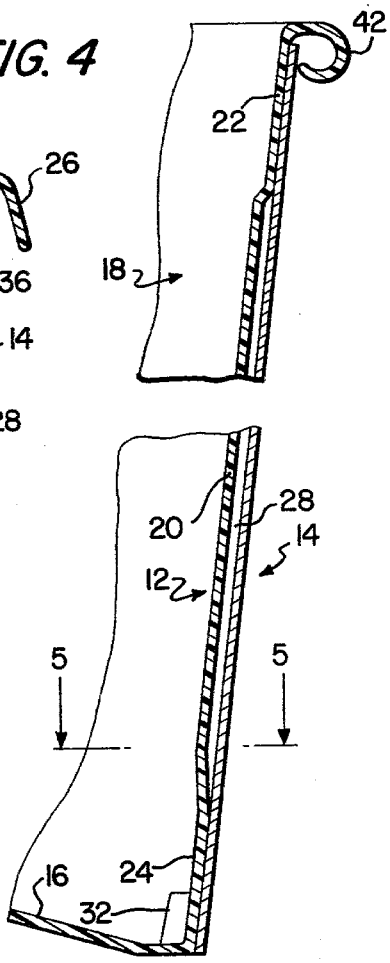
FIG. 4 is a view similar to that of FIG. 3, but showing the complete cup having an uppermost circumferential bead.
Figure 6:
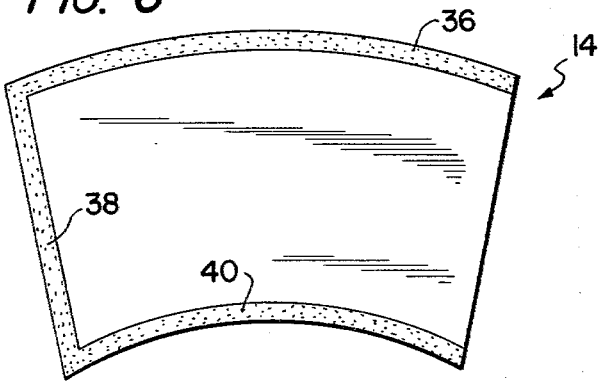
FIG. 6 is an elevational view of an overwrap to be applied to the sidewall of a cup member in accordance with the invention.

In more detail, cup member 12 is an integral unit preferably formed of impact grade polystyrene material having an izod impact strength of from about 0.5 to 1.5. The member 12 includes a circular, concaval-convex bottom wall 16 and an upwardly extending, generally frustoconical sidewall 18. As best seen in FIG. 4, the sidewall 18 is formed to present a circular in cross section major surface 20 which is bounded at top and bottom by respective annular bands 22, 24. The bands are spaced outwardly a short distance (from about 0.012 to 0.025 inches, most preferably about 0.018 inches) from the major surface 20.

Figure 3:
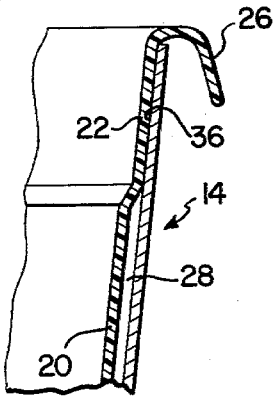
FIG. 3 is a fragmentary vertical sectional view illustrating the orientation of the paper overwrap relative to the cup member sidewall and prior to the formation of the circumferential bead.

The lowermost end of annular band 24 directly connects to bottom wall 16, whereas the uppermost end of the band 22 merges into a circumferential bead-forming lip section 26 (see Fig. 3).

The exterior surface of the sidewall 18 is further provided with a series of elongated, spaced, longitudinally extending, side-by-side spacer ribs 28 which are equally circumferentially spaced about the sidewall 18.

Figure 2:
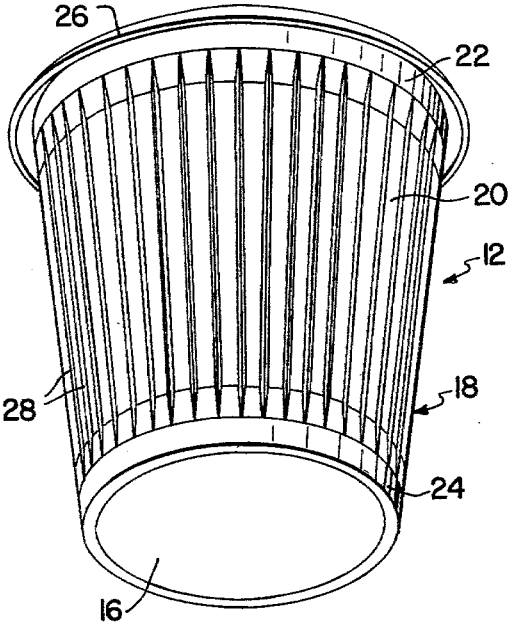
FIG. 2 is a perspective view of a synthetic resin cup member forming a part of the overall cup of the invention.
Figure 5:
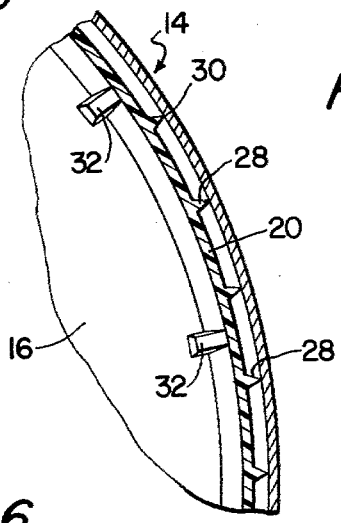
FIG. 5 is a sectional view taken along line 5—5 of FIG. 4 which further illustrates the sidewall construction of the overall cup.

The ribs 28 merge into and are connected to the annular bands 22, 24, as best seen in FIG. 2, and moreover extend outwardly from the major surface 20 a distance equal to the distance of the bands 22, 24 from the major surface 20. Referring to FIG. 5, it will be seen that each of the ribs 28 is substantially triangular in cross section, and presents, at the outermost extremity thereof, a relatively sharp pointed contact line 30.

A series of circumferentially spaced, upstanding, block-like projections or nibs 32 are formed in the cup member 12 at the point of interconnection between bottom wall 16 and sidewall 18. The purpose of the nibs 32 is to facilitate one-by-one detachment of cups from a nested stack thereof.

Overwrap 14 is formed of conventional die cut paper stock and normallly is provided with a printed decoration 34 on the outer surface thereof. The overwrap 14 is sized to wrap about and engage the outermost surface of the sidewall 18 as will be explained; furthermore, the inner face of the overwrap 14 may be provided with three glue lines 36, 38 and 40 for the purpose of securely connecting the overwrap to the sidewall 18 of cup member 12.

Referring to FIGS. 3 and 4, it will be seen that overwrap 14 is in direct, adhesive contact with the annular bands 22, 24 (adhesive strip 36 being secured to the upper band 22, whereas adhesive strip 40 connects to the lower band 24).

Furthermore, it will be appreciated that the outermost contact lines 30 of the ribs 28 are in essentially line contact with the paper overwrap 40. This is important inasmuch as only minimal thermal contact is thus established between the sidewall 18 of cup member 12, and the overwrap 14.

The finished cup 10 in accordance with the invention includes a circumferential, uppermost bead 42 formed from the section 26 and extending downwardly and turned in for engagement with the upper margin of the overwrap 14. Such a bead is of course known, but it will be observed in this connection that the bead effectively presents a seal which precludes the passage of liquid between the sidewall 18 and overwrap 14.

When a polystyrene material of the type described above is used for the formation of cup member 12, it has been found that the thickness thereof should be from about 0.015 to 0.020 inches. In this fashion adequate strength is imparted to the cup member, without wastage of material. Furthermore, spacer ribs 28 are advantageously formed to present an included angle of about 60° at their apices, and with the sharpest contact line presently available through a molding process, i.e., about a 0.005 inch radius.

The paper employed for the liner 14 is preferably 11 point stock (0.011 inches in thickness) clay coated bleached paper; such has been found advantageous for printing purposes and is also relatively opaque and has sufficient strength for normal handling.

In constructing the cup 10 of the invention, the overwrap 14 may be wrapped about the sidewall 18 of cup member 12, and a permanent connection effected by means of the glue lines 36, 38 and 40. Optionally, a preprinted, die cut blank can be wrapped about an appropriately shaped mandrel with the overlapping edges thereof glued so as to present a frustoconical sleeve. Respective strips of adhesive material can then be placed around the bands 22, 24 of the cup member 12, whereupon the latter can be inserted into the frustoconical sleeve with the uppermost margin of the latter coming into close proximity with the outwardly extending circumferential lip-forming portion 26 (see FIG. 3).

The final step of cup manufacture involves formation of the bead 42. This is accomplished by heating the section 26 to soften the polystyrene material, and a finished bead 42 is formed about the uppermost margin of the cup in the manner illustrated in FIG. 4.

Actual thermal tests of a cup 10 in accordance with the invention have demonstrated that the thermal insulating qualities of the laminated cup hereof are substantially equal to that of known foamed synthetic resin cups. At the same time, the cups of the invention can be provided with virtually any surface decoration, so that they can be used in matched party sets or the like.

Having thus described the invention, what is claimed as new and desired to be secured by Letters Patent is:

1. A hot drink cup, comprising:

a cup member formed of synthetic resin material and having a bottom wall and an upwardly extending, continuous sidewall connected to the bottom wall for cooperatively presenting a liquid-holding cavity;

said sidewall including structure which defines, on the exterior face thereof, (1) a pair of annular, continuous bands respectively extending about said sidewall, being located adjacent the upper and lower extremities of said sidewall, and spaced outwardly from the major surface presented by said sidewall; and (2) a series of elongated, spaced, side-by-side spacer ribs disposed in an upright relation, extending between said bands and outwardly from said major surface, and presenting, on the outermost extremities thereof, respective, relatively sharp, pointed contact lines; and an overlap disposed about said sidewall, and in engagement with said bands and contact lines, said ribs, member sidewall and overwrap cooperatively defining a series of elongated, discrete dead air cells for creating a heat insulation barrier between hot liquid in said cavity and a person's hand in engagement with the exterior surface of said overlay.

2. The cup as set forth in claim 1 including a circular bead formed at the upper end of said member sidewall which extends outwardly and engages the upper margin of said overwrap.

3. The cup as set forth in claim 1 wherein said overwrap is adhesively secured to said bands.

4. The cup as set forth in claim 1 wherein said cup member is formed of impact grade polystyrene having an izod impact strength of from about 0.5 to 1.5.

5. The cup as set forth in claim 4 wherein said major surface of said member sidewall has a thickness of from about 0.015 to 0.020 inches.

6. The cup as set forth in claim 1 wherein said bands are spaced a distance of from about 0.012 to 0.025 inches from said major surface.

7. The cup as set forth in claim 1 wherein said ribs extend outwardly from said major surface a distance equal to the distance of said bands from said major surface.

8. The cup as set forth in claim 1 wherein said ribs are of triangular cross-section.

9. A hot drink cup, comprising:

a cup member formed of synthetic resin material and having a bottom wall and an upwardly extending, continuous sidewall connected to the bottom wall for cooperatively presenting a liquid-holding cavity;

said sidewall including structure which defines, on the exterior face thereof, (1) an annular, continuous band extending about said sidewall, located adjacent the upper extremity of said sidewall, and spaced outwardly from the major surface presented by said sidewall; and (2) a series of elongated, spaced, side-by-side spacer ribs disposed in an upright relation, extending from said band and outwardly from said major surface, and presenting, on the outermost extremities thereof, respective, relatively sharp, pointed contact lines; and an overlap disposed about said sidewall and in engagement with said band and contact lines.

* * * * *